US008353067B2

(12) United States Patent
Chen et al.

(10) Patent No.: US 8,353,067 B2
(45) Date of Patent: Jan. 15, 2013

(54) UMPIRE CHEST PROTECTOR

(75) Inventors: Shyan-Wei Chen, New Taipei (TW); Brad Jurga, Shirley, MA (US)

(73) Assignee: Racer Sporting Goods Co., Ltd., New Taipei (TW)

( * ) Notice: Subject to any disclaimer, the term of this patent is extended or adjusted under 35 U.S.C. 154(b) by 125 days.

(21) Appl. No.: 13/154,772

(22) Filed: Jun. 7, 2011

(65) Prior Publication Data

US 2012/0311774 A1 Dec. 13, 2012

(51) Int. Cl.
*A41D 13/00* (2006.01)

(52) U.S. Cl. ..... 2/463; 2/461; 2/464; 2/2.5; 2/45

(58) Field of Classification Search ..... 2/463, 455, 2/459, 464, 92, 267, 466, 2.5, 94, 913, 465, 2/468, 462, 102
See application file for complete search history.

(56) References Cited

U.S. PATENT DOCUMENTS 4,989,265 A * 2/1991 Nipper et al. ..... 2/462
5,530,966 A * 7/1996 West ..... 2/462
5,623,729 A * 4/1997 Chen ..... 2/461
6,775,851 B1 * 8/2004 Chen et al. ..... 2/463
7,900,283 B1 * 3/2011 Chen ..... 2/455
2004/0128748 A1 * 7/2004 Monica ..... 2/462
2011/0239355 A1 * 10/2011 Lee ..... 2/461

* cited by examiner

*Primary Examiner* — Khoa Huynh
*Assistant Examiner* — Khaled Annis
(74) *Attorney, Agent, or Firm* — Jackson IPG PLLC

(57) ABSTRACT

An umpire chest protector for use in a baseball game is disclosed to include a body member, a sternum plate, first left and right side plates, second left and right side plates, two shoulder plates, a shoulder strap assembly and a rear padding system. The rear padding system has an air channel defined therein, saving material, reducing the weight and enhancing wearing comfort. The left and right paddings, upper padding, outer left padding and outer right padding of the rear padding system are detachable, easy on and off and washable, material-saving and capable of dispersing impact force. The sternum plate is attached to one side of each of the shoulder plates and affixed thereto with rivets, and side flaps and bottom flaps of the sternum plate are respectively affixed to the upper portions and lower portions of the first left and right side plates with rivets, providing warp around feel and making the protector still and strong.

10 Claims, 4 Drawing Sheets

UMPIRE CHEST PROTECTOR

BACKGROUND OF THE INVENTION

1. Field of the Invention

The present invention relates to chest protection technology and more particularly, to an umpire chest protector for protecting the chest of an umpire in a baseball game.

2. Description of the Related Art

In a conventional umpire chest protector for the game of baseball, as shown in FIG. 1, the sternum plate 81 is overlapped with the lower portion 821 of each of the two shoulder plates 82 and locked together, however, a transverse gap 80 is left between the sternum plate 81 the lower plate 83. When a ball hits a part of the umpire chest protector around the transverse gap 80, the lower plate 83 will be curved inwards, causing the umpire to get hurt. Further, this design of umpire chest protect has the disadvantages of poor ventilation, heavy weight and wearing uncomfortability.

Accordingly, there is a need for an umpire chest protector that eliminates the aforesaid problems.

SUMMARY OF THE INVENTION

The present invention has been accomplished to provide an umpire chest protector, which has the characteristics of good ventilation, material saving, light weight and wearing comfort.

To achieve this and other objects of the present invention, an umpire chest protector includes a body member, a sternum plate, first left and right side plates, second left and right side plates, two shoulder plates, a shoulder strap assembly and a rear padding system. The rear padding system has an air channel defined therein, saving material, reducing the weight and enhancing wearing comfort. The left and right paddings, upper padding, outer left padding and outer right padding of the rear padding system are detachable, easy on and off and washable, material-saving and capable of dispersing impact force. The sternum plate is attached to one side of each of the shoulder plates and affixed thereto with rivets, and side flaps and bottom flaps of the sternum plate are respectively affixed to the upper portions and lower portions of the first left and right side plates with rivets, providing wrap around feel, making the protector still and strong, and avoiding pain when hit by the ball.

DETAILED DESCRIPTION OF THE INVENTION

Figure 1:
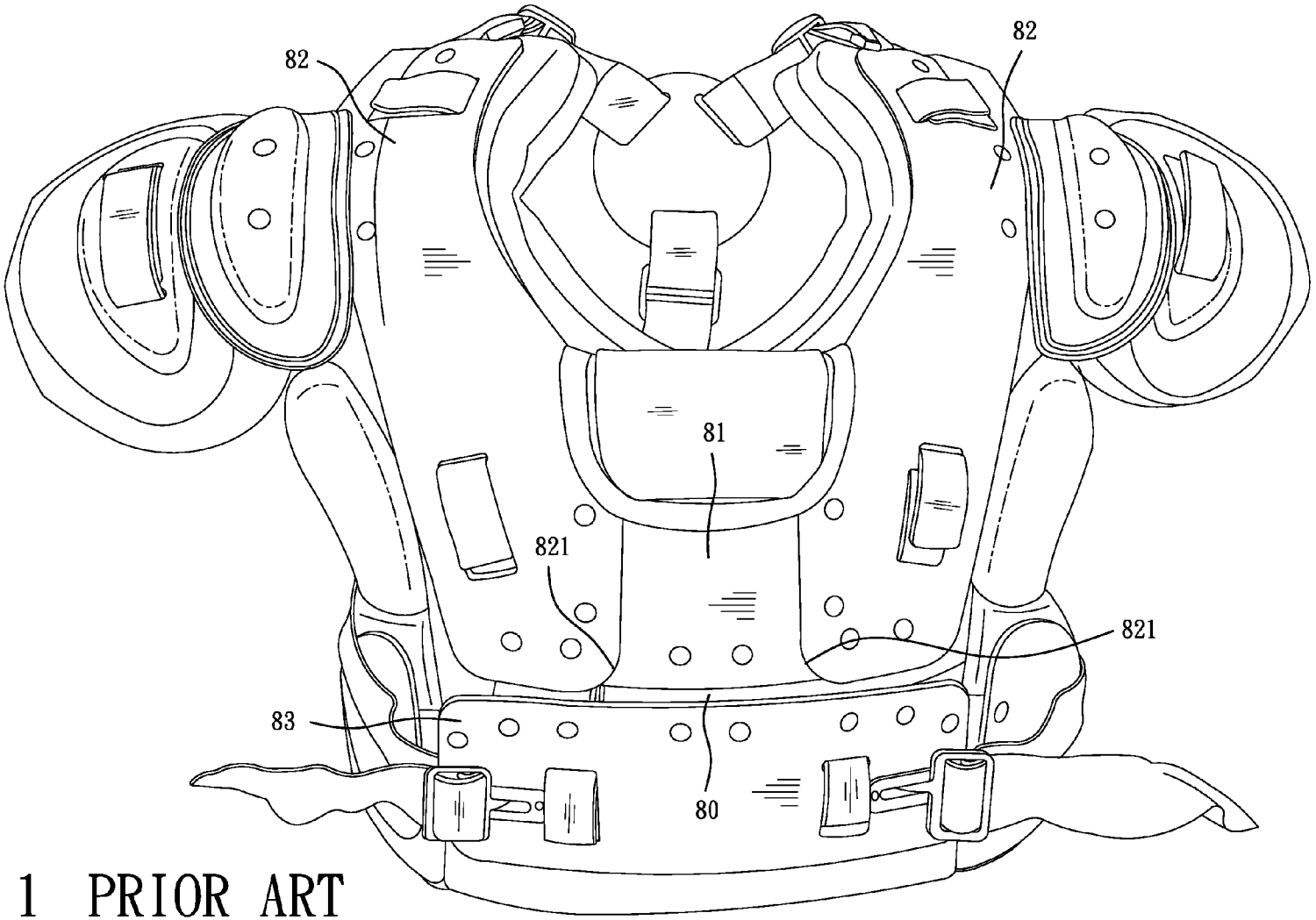
Fig. 1 PRIOR ART
FIG. 1 is an elevational view of an umpire chest protector according to the prior art.
Figure 2:
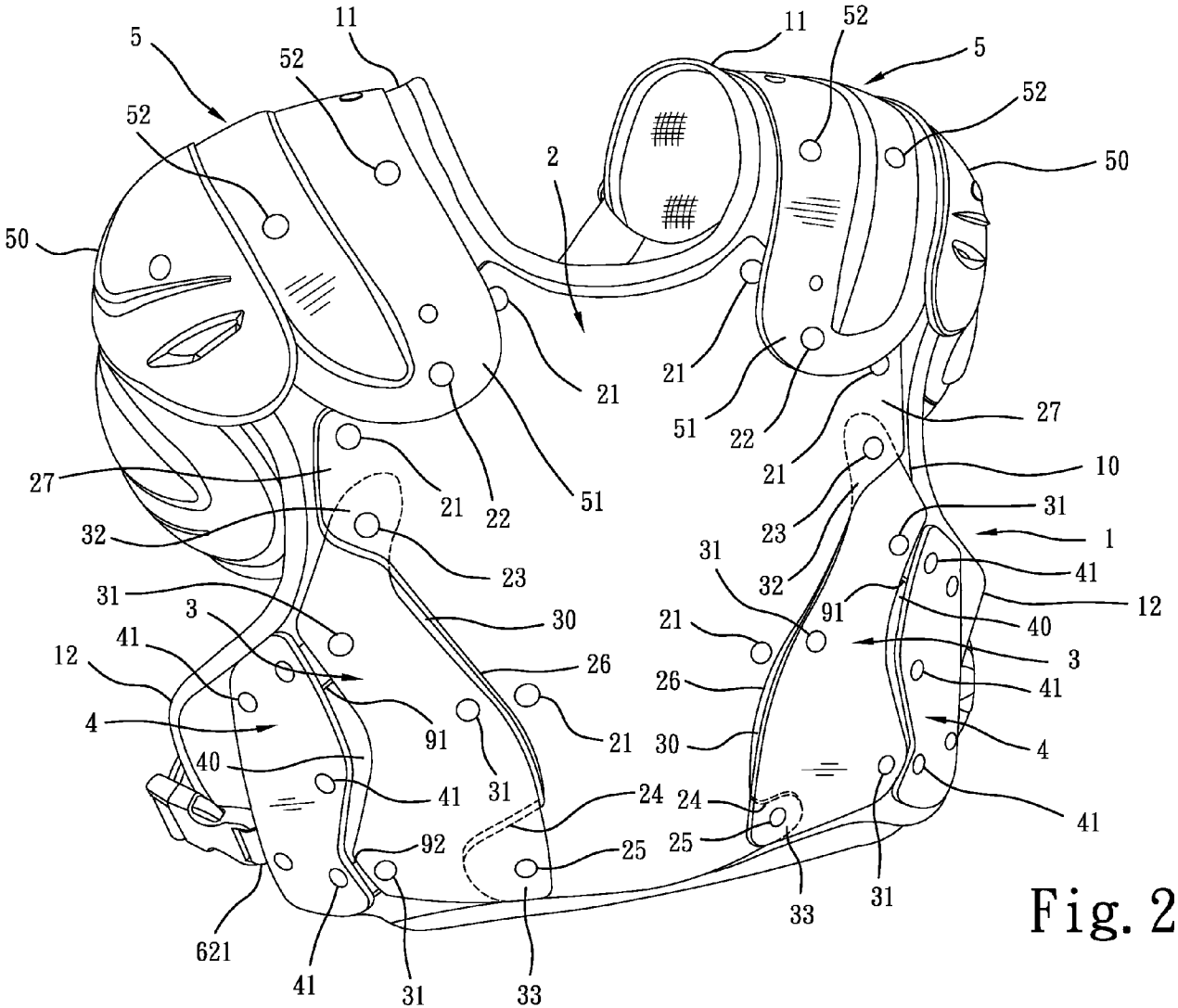
FIG. 2 is a perspective view of an umpire chest protector according to the present invention.
Figure 3:
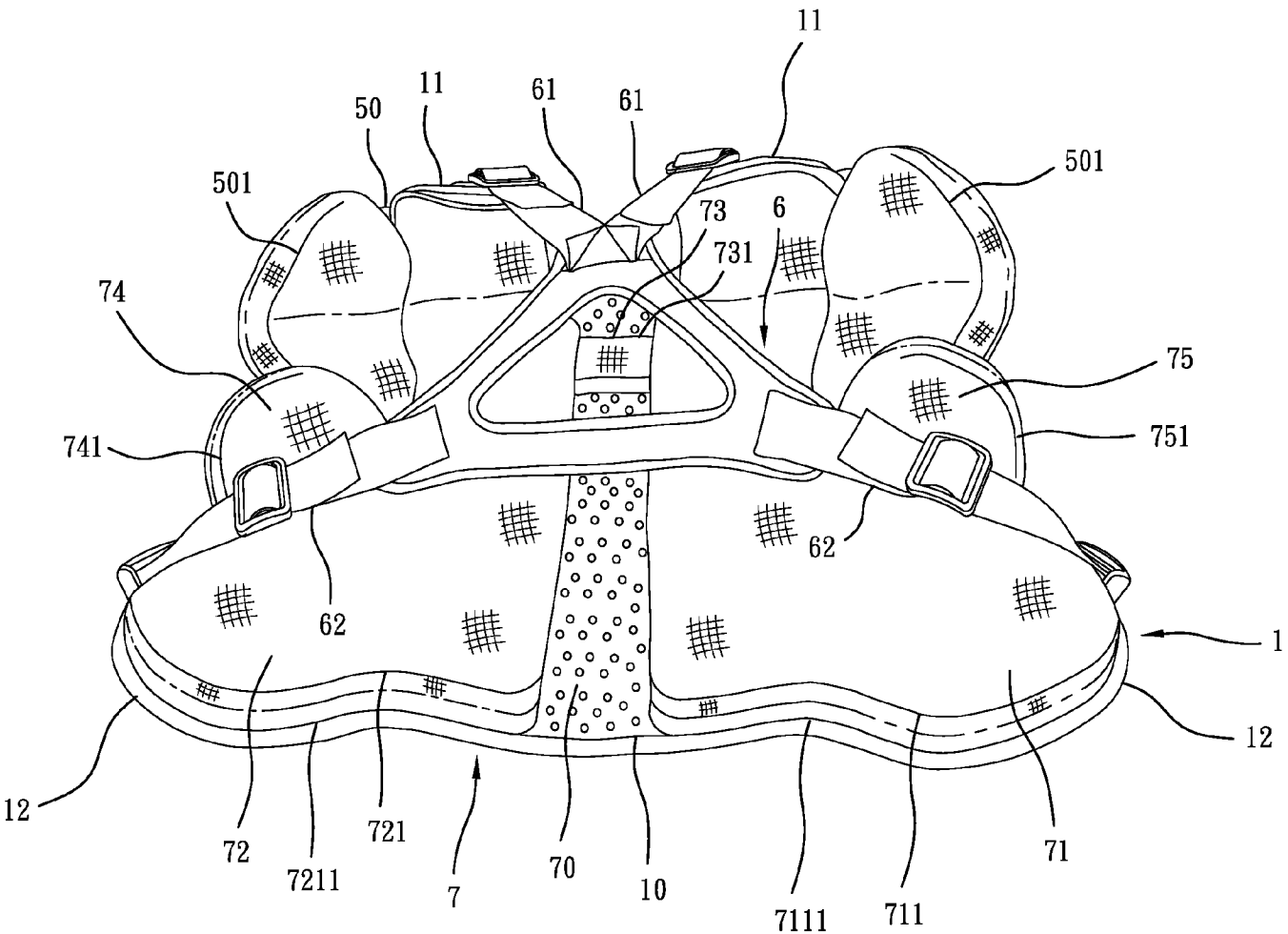
FIG. 3 is a rear side view of the umpire chest protector according to the present invention.
Figure 4:
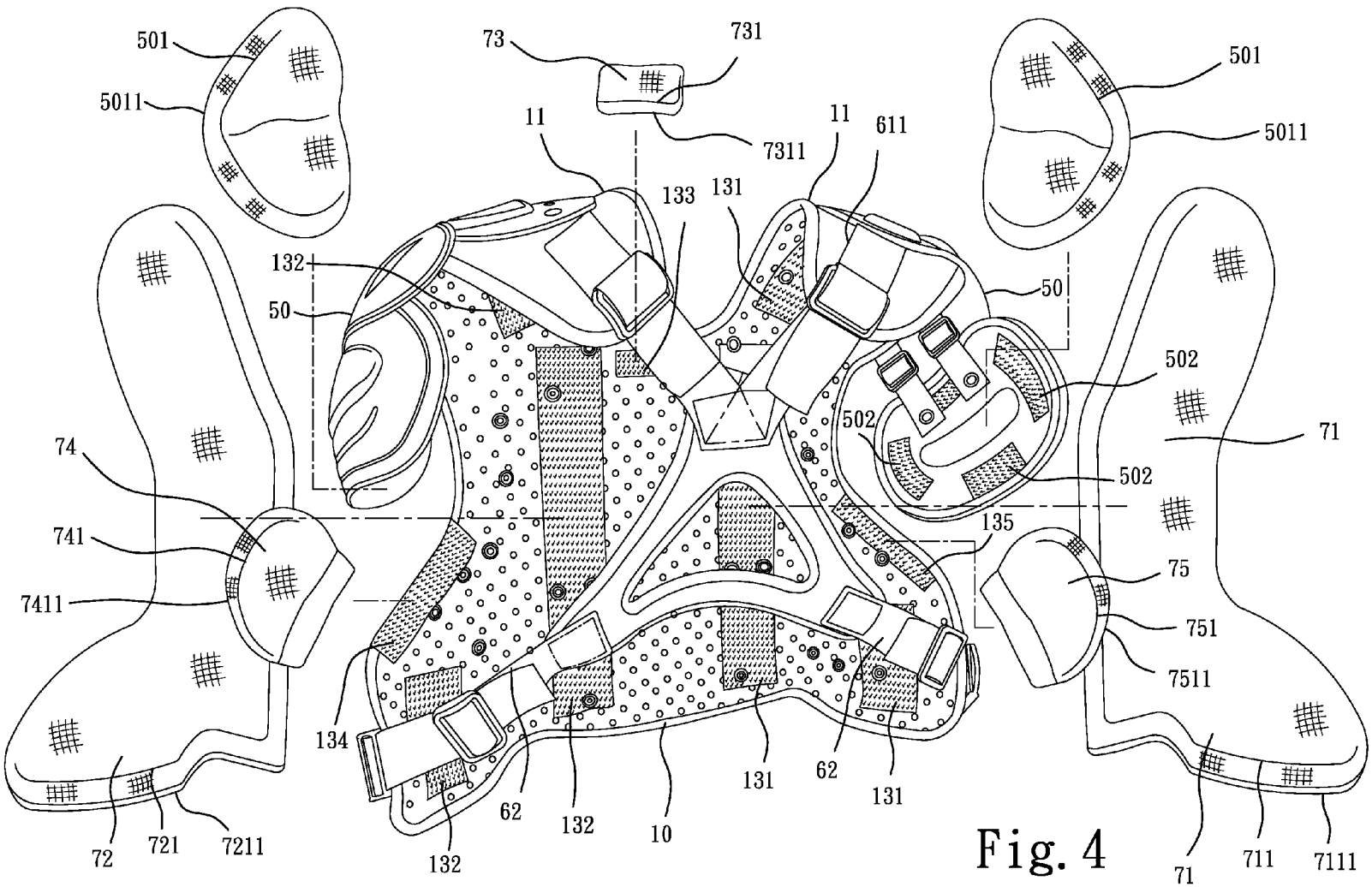
FIG. 4 is an exploded rear side view of the umpire chest protector according to the present invention.

Referring to FIGS. 2-4, an umpire chest protector in accordance with the present invention is shown for wearing by an umpire in a baseball game, comprising:

a body member 1, which is made of a predetermined thickness of ethylene vinyl acetate foam material not heat pressed, and covered with a waterproof breathing cloth covering 10, having left and right shoulder portions 11 bilaterally disposed at the top side thereof and left and right bottom protrusions 12 bilaterally disposed at the bottom side thereof;

a sternum plate 2, which is fastened to the front side of the body member 1 with rivets 21, having opposing side flaps 27 respectively extended from left and right sides thereof and opposing bottom flaps 24 respectively bilaterally extended from the bottom side thereof (see the imaginary lines in FIG. 2);

first left and right side plates 3, which are respectively affixed to the left and right sides of the body member 1 with rivets 31, having the respective upper portions 32 thereof respectively attached to the side flaps 27 of the sternum plate 2 and affixed thereto with rivets 23 and the respective lower portions 33 thereof respectively attached to the bottom flaps 24 of the sternum plate 2 and affixed thereto with rivets 25 and leaving a gap 30 between each of the first left and right side plates 3 and the corresponding one of the left and right side edges 26 of the sternum plate 2 to facilitate movement of the umpire;

second left and right side plates 4, which are respectively affixed to the left and right sides of the body member 1 with rivets 41 at an outer side relative to the first left and right side plates 3, leaving a gap 40 between each of the second left and right side plates 4 and the corresponding one of the first left and right side plates 3 to facilitate movement of the umpire;

two shoulder plates 5 affixed to the left and right shoulder portions 11 of the body member 1 with rivets 52, each having one side 51 thereof respectively affixed to the opposing left and right sides of the sternum plate 2 with rivets 22 and a respective shoulder pad 50 fixedly secured to an outer side thereof;

a shoulder strap assembly (see also FIG. 3), which comprises two adjustable upper shoulder straps 61 respectively connected with the respective upper ends 611 (see also FIG. 4) to the left and right shoulder portions 11 of the body member 1, and two adjustable lower shoulder straps 62 respectively connected with the respective lower ends 621 to the left and right bottom protrusions 12 of the body member 1; and a rear padding system 7 (see FIG. 3), which consists of detachable left and right paddings 71; 72, an upper padding 73, an outer left padding 74 and an outer right padding 74 and defines at least one air channel 70 in between the upper padding 73 and the left and right paddings 71; 72.

Further, the left and right paddings 71; 72, upper padding 73, outer left padding 74 and outer right padding 75 of the rear padding system 7 can be made of non-heat pressed ethylene vinyl acetate foam material and 3D mesh fabric, and covered with a respective waterproof breathing cloth covering 711; 721; 731; 741; 751 that is provided with a respective releasable hook-loop fastening strip 7111; 7211; 7311; 7411; 7511 detachably fastenable to a respective releasable hook-loop fastening strip 131; 132; 133; 134; 135 at the left, right, upper, left outer or right outer side of the back wall of the body member 1 (see FIG. 4). Alternatively, the left and right paddings 71; 72, upper padding 73, outer left padding 74 and outer right padding 75 of the rear padding system 7 can be formed of a respective air bag.

Further, the sternum plate 2 is prepared by polyethylene or carbon fiber. Further, the first left and right side plates 3, the second left and right side plates 4 and the shoulder plates 5 are respectively prepared by polyethylene.

Referring to FIG. 4 again, the shoulder pads 50 of the shoulder plates 5 are respectively attached with one respective padding 501 at the back side. Each padding 501 is provided with a releasable hook-loop fastening strip 5011 detachably fastenable to one respective releasable hook-loop fastening strip 502 at each of the shoulder pads 50.

Further, the first left and right side plates 3 and the second left and right side plates 4 are respectively connected together with durable coated nylon band of material 91; 92.

In conclusion, the umpire chest protector of the present invention provides the following advantages.

1. The design of at least one air channel 70 in the rear padding system 7 saves material consumption, reduces the weight, and enhances wearing comfort.

2. The left and right paddings 71; 72, upper padding 73, outer left padding 74 and outer right padding 75 of the rear padding system 7 are detachable, easy on and off and washable, material-saving and capable of dispersing impact force.

3. The sternum plate 2 is attached to one side 51 of each of the shoulder plates 5 and affixed thereto with rivets 52, and the side flaps 27 and bottom flaps 24 of the sternum plate 2 are respectively affixed to the upper portions 32 and lower portions 33 of the first left and right side plates 3 with rivets 23; 25, providing wrap around feel and making the protector still and strong and avoiding pain when hit by the ball.

4. All the plates 2; 3; 4; 5 on the body member 1 of the umpire chest protector are either rivet together or connected with durable coated nylon band of material 91; 92 When the plates 2; 3; 4; 5 are impacted, no one plate will take the entire impact. Instead, the force will be transferred to the rest of the protector for the best protection.

What is claimed is:

1. An umpire chest protector comprising:

a body member made of a predetermined thickness of non-heat pressed ethylene vinyl acetate foam material and covered with a waterproof breathing cloth covering, said body member comprising left and right shoulder portions bilaterally disposed at a top side thereof and left and right bottom protrusions bilaterally disposed at a bottom side thereof;

a sternum plate fastened to the front side of said body member with rivets;

first left and right side plates respectively affixed to left and right sides of said body member with rivets and respectively spaced laterally from left and right side edges of said sternum plate by a gap;

second left and right side plates respectively affixed to left and right sides of said body member with rivets at an outer side relative to said first left and right side plates and respectively spaced from said first left and right side plates by a gap;

two shoulder plates affixed to the left and right shoulder portions of said body member with rivets, each said shoulder plate having one side thereof respectively affixed to said sternum plate with rivets and an outer side thereof provided with a shoulder pad;

a shoulder strap assembly, said shoulder strap assembly comprising two adjustable upper shoulder straps respectively connected to the left and right shoulder portions of said body member, and two adjustable lower shoulder straps respectively connected to the left and right bottom protrusions of said body member; and a rear padding system, which consists of detachable left and right paddings, an upper padding, an outer left padding and an outer right padding and defining at least one air channel in between said upper padding and said left and right paddings; wherein said plates are permanently affixed to an outer surface of the body member facing away from the wearer; wherein said left padding, right padding, upper padding, outer left padding and outer right padding components are separate components and removably attached to each other; wherein said padding components are removably attached to a rear side of the body member facing the wearer.

2. The umpire chest protector as claimed in claim 1, wherein the left and right paddings, upper padding, outer left padding and outer right padding of said rear padding system are made of non-heat pressed ethylene vinyl acetate foam material and 3D mesh fabric, and covered with a respective waterproof breathing cloth covering that is provided with a respective releasable hook-loop fastening strip detachably fastenable to a respective releasable hook-loop fastening strip at said body member.

3. The umpire chest protector as claimed in claim 1, wherein the left and right paddings, upper padding, outer left padding and outer right padding of said rear padding system are respectively formed of an air bag and provided with a respective releasable hook-loop fastening strip detachably fastenable to a respective releasable hook-loop fastening strip at said body member.

4. The umpire chest protector as claimed in claim 1, wherein said sternum plate is selected from the material group of polyethylene and carbon fiber; said first left and right side plates, said second left and right side plates and said shoulder plates are respectively prepared by polyethylene.

5. The umpire chest protector as claimed in claim 1, wherein said sternum plate further comprises two opposing side flaps and two opposing bottom flaps; said first left and right side plates have a respective upper portion thereof respectively attached to the side flaps of said sternum plate and affixed thereto with rivets and a respective lower portion thereof respectively attached to the bottom flaps of said sternum plate and affixed thereto with rivets.

6. The umpire chest protector as claimed in claim 1, wherein said first left and right side plates and said second left and right side plates are respectively connected together with a respective durable coated nylon band of material.

7. An umpire chest protector comprising:

a body member made of a predetermined thickness of non-heat pressed ethylene vinyl acetate foam material and covered with a waterproof breathing cloth covering, said body member comprising left and right shoulder portions bilaterally disposed at a top side thereof and left and right bottom protrusions bilaterally disposed at a bottom side thereof;

a sternum plate fastened to the front side of said body member with rivets, said sternum plate comprising opposing side flaps respectively extended from left and right sides thereof and opposing bottom flaps respectively bilaterally extended from a bottom side thereof;

first left and right side plates respectively affixed to left and right sides of said body member with rivets and respectively spaced laterally from left and right side edges of said sternum plate by a gap, said first left and right side plates each having a respective upper portion thereof respectively attached to the side flaps of said sternum plate and affixed thereto with rivets and a respective lower portion thereof respectively attached to the bottom flaps of said sternum plate and affixed thereto with rivets;

second left and right side plates respectively affixed to left and right sides of said body member with rivets at an outer side relative to said first left and right side plates and respectively spaced from said first left and right side plates by a gap;

two shoulder plates affixed to the left and right shoulder portions of said body member with rivets, each said shoulder plate having one side thereof respectively affixed to said sternum plate with rivets and an outer side thereof provided with a shoulder pad;

a shoulder strap assembly, said shoulder strap assembly comprising two adjustable upper shoulder straps respectively connected to the left and right shoulder portions of said body member, and two adjustable lower shoulder straps respectively connected to the left and right bottom protrusions of said body member; and a rear padding system, which consists of detachable left and right paddings, an upper padding, an outer left padding and an outer right padding and defining at least one air channel in between said upper padding and said left and right paddings; wherein said plates are permanently affixed to an outer surface of the body member facing away from the wearer; wherein said left padding, right padding, upper padding, outer left padding and outer right padding components are separate components and removably attached to each other; wherein said padding components are removably attached to a rear side of the body member facing the wearer.

8. The umpire chest protector as claimed in claim 7, wherein the left and right paddings, upper padding, outer left padding and outer right padding of said rear padding system are made of non-heat pressed ethylene vinyl acetate foam material and 3D mesh fabric, and covered with a respective waterproof breathing cloth covering that is provided with a respective releasable hook-loop fastening strip detachably fastenable to a respective releasable hook-loop fastening strip at said body member.

9. The umpire chest protector as claimed in claim 7, wherein the left and right paddings, upper padding, outer left padding and outer right padding of said rear padding system are respectively formed of an air bag and provided with a respective releasable hook-loop fastening strip detachably fastenable to a respective releasable hook-loop fastening strip at said body member.

10. The umpire chest protector as claimed in claim 7, wherein said sternum plate is selected from the material group of polyethylene and carbon fiber; said first left and right side plates, said second left and right side plates and said shoulder plates are respectively prepared by polyethylene.

* * * * *